United States Patent [19]

de Man

[11] Patent Number: 4,673,108

[45] Date of Patent: Jun. 16, 1987

[54] BEVERAGE DISPENSING GUN

[76] Inventor: Heiko T. de Man, 33,000 S. Highway 1, Gualala, Calif. 95445

[21] Appl. No.: 564,988

[22] Filed: Dec. 23, 1983

[51] Int. Cl.[4] ..... B67D 5/06; H01H 9/04; H01H 13/06; H01H 13/70

[52] U.S. Cl. ..... 222/144.5; 200/5 A; 200/340; 439/43; 439/191

[58] Field of Search ..... 222/144.5, 145, 132, 222/173; 239/112, 113, 428, 418, 422, 423, 432, 433; 200/5 A, 340; 220/4 B; 339/60 R, 60 M, 94 R, 94 M, 17 LC, 17 LM, 17 M, 17 F; 350/114

[56] References Cited

U.S. PATENT DOCUMENTS

| | | | |
|---|---|---|---|
| 3,214,713 | 10/1965 | Strobel | 339/17 F |
| 3,241,720 | 3/1966 | Barney | 222/144.5 |
| 3,278,890 | 10/1966 | Cooney | 339/252 R |
| 3,542,941 | 11/1970 | Menzel | 220/4 B |
| 3,691,985 | 9/1972 | Otterlei | 200/340 |
| 3,995,126 | 11/1976 | Larson | 200/340 |
| 4,028,509 | 6/1977 | Zurcher | 200/5 A |
| 4,116,517 | 9/1978 | Selvin et al. | 339/17 F |
| 4,145,584 | 3/1979 | Otterlei | 200/5 A |
| 4,160,886 | 7/1979 | Wright et al. | 200/5 A |
| 4,163,138 | 7/1979 | Harden | 200/5 A |
| 4,184,321 | 1/1980 | Tarusawa | 200/159 B |
| 4,194,099 | 3/1980 | Mickelson | 200/5 A |
| 4,218,014 | 8/1980 | Tracy | 222/144.5 |
| 4,273,288 | 6/1981 | Lagneaux | 239/432 |
| 4,293,754 | 10/1981 | Komaki | 200/5 A |
| 4,317,012 | 2/1982 | Itoh | 200/5 A |
| 4,365,130 | 12/1982 | Christensen | 200/5 A |
| 4,376,879 | 3/1983 | Nagata et al. | 200/340 |
| 4,433,795 | 2/1984 | Maiefski et al. | 222/144.5 |
| 4,516,820 | 5/1985 | Kuzma | 339/60 M |
| 4,526,432 | 7/1985 | Cronin et al. | 339/17 F |

FOREIGN PATENT DOCUMENTS

| | | | |
|---|---|---|---|
| 0073528 | 3/1983 | European Pat. Off. | 339/17 F |

*Primary Examiner*—Charles A. Marmor
*Assistant Examiner*—Kevin P. Shaver
*Attorney, Agent, or Firm*—Townsend and Townsend

[57] ABSTRACT

A beverage dispensing gun includes a case housing a replaceable nozzle, which defines a number of liquid passageways, and a beverage selection button array. The liquid passageways are connected to flexible liquid lines. A printed circuit (PC) board, mounted within the case underlying the button array, includes pressure actuated switches actuated when the corresponding button is depressed. Holes in the rigid PC board beneath each button house light emitting diodes to light up the buttons to aid visibility. The PC board is protected from moisture using a flexible plastic film on the upper surface and a rubber boot covering the bottom and the peripheral edge of the PC board. A metal band sealingly secures the peripheral edge of the rubber boot to the PC board. The speed of the liquid is reduced as it passes through the nozzle by increasing the area of the passageway. This is achieved by either injecting the fluid into a common, enlarged passageway section or by enlarging each passageway with a venturi region. Different nozzles are provided for different operating conditions.

22 Claims, 10 Drawing Figures

BEVERAGE DISPENSING GUN

BACKGROUND OF THE INVENTION

One requirement for efficient bartending is that the bartender dispense drinks with speed and accuracy. Speed is necessary so that everyone gets served promptly. Accurate portion control, particularly the accurate measurement of the alcoholic beverage served with each drink, is critical to the maintenance of a reasonable profit.

One way to achieve these objectives is by the use of a conventional beverage dispensing gun in making mixed drinks. The gun is connected to a number of beverages so that different drinks can be made using the same beverage gun. Some guns use simple on-off switches to control the flow of beverages, including alcoholic beverages and mixers, such as club soda or water. With such guns the amount needed is determined by how long the switch is depressed. The operator thus controls the amount with this type of gun.

With other beverage dispensing guns the amount discharged is automatically metered for enhanced portion control. However, these guns have proven less than totally satisfactory in operation. One problem, aside from the proper metering of the beverage, is that the electrical switches housed within the beverage gun are subjected to a wet environment, which is very detrimental to proper operation.

Another drawback with the prior art beverage dispensing guns is that the number of beverages which can be accommodated is limited by the size of the individual liquid lines connecting the beverage sources to the nozzle. The hose connecting the beverage gun to the beverage sources must necessarily be relatively small diameter to permit proper flexibility and to keep the hose from becoming too large and unwieldy. However, there is a tradeoff between the diameter of the liquid lines and the speed of discharge of the beverage and resulting splash. It is desired that the beverage be dispensed as rapidly as possible to increase the speed at which drinks can be made. However, increasing the speed of beverage discharge increases splash which also must be minimized. Therefore, the number of different beverages carried by a single prior art beverage gun is limited because the individual liquid lines connected to the gun each must have a sufficiently large diameter to keep the liquid speed to a reasonable level.

Another problem with prior art beverage dispensing guns arises because of the dark environment found in a typical bar. Because of the dim lighting conditions, the indicia on various selector buttons depressed by the operator to select the individual beverages are often obscure which adds to the chance of making mistakes.

Another shortcoming of prior art beverage dispensing guns arises form the different operational requirements of different users. For example, in some jurisdictions separate beverage conduits must be maintained for each different alcoholic beverage; some users require the ability to dispense a number of soft drinks from the same beverage dispensing gun used for alcoholic beverages. Because of these different requirements, different models of beverage dispensing guns must be made and stocked by the manufacturer. This is a great additional expense, both from the standpoint of manufacturing and inventory maintenance.

SUMMARY OF THE INVENTION

The present invention is directed to a beverage dispensing gun which provides a simple, waterproof switch board assembly, will accommodate a great number of beverages delivered at acceptable flow rates without producing unacceptable splash and which provides highly readable selector button indicia under low light conditions. In addition, the invention reduces the manufacturing and inventory requirements to accommodate the different configurations required by users by using a replaceable nozzle. This eliminates the need to have a different beverage gun model for each environment to reduce inventory requirements and manufacturing expense.

The beverage dispensing gun includes a case having a nozzle compartment and a beverage selection button array. The nozzle compartment houses a nozzle which defines a number of liquid passageways. The entrance ends of the liquid passageways are connected to flexible liquid lines. The liquid passes out of the gun through the exit ends of the liquid passageways.

A switch board assembly, including a rigid printed circuit (PC) board, is mounted within the case underlying the button array. The switch board assembly includes an array of normally open pressure actuated switches which are actuated (closed) when the corresponding button is depressed by the user. The various beverages are forced through the various liquid lines for discharge through the nozzle assembly according to which button on the button assembly is pressed.

A hole is formed in the rigid PC board beneath each button and houses a light emitting diode (LED) therein. The LEDs illuminate the overlying buttons to aid the readability of the button indicia in dimly lit areas. Housing the LEDs within holes in the PC board keeps the switch board assembly thin. This aids the proper proportioning of the housing to fit the user's hand.

A spacer film is applied to the upper surface of the rigid PC board except in regions surrounding the holes. Printed circuits are mounted to the upper surface in the regions surrounding the holes and act as first PC contacts of the pressure sensitive switches. A flexible PC board, typically a piece of clear Mylar having a printed circuit applied to its lower surface, is mounted to the upper surface of the spacer film. The portions of the electrical circuit on the flexible printed circuit board overlying the electrical circuits surrounding the LED holes act as second PC contacts of the pressure sensitive switches. Pressing on a button pushes the flexible PC board towards the rigid PC board causing the first and second PC contacts to make electrical contact.

The buttons are made of clear material so the light from the LEDs shine through the buttons. The buttons preferably have upper surfaces to which metallized foil with opaque indicia is applied. The metallized foil acts as a one way mirror. Therefore in low light conditions light shines through the metallized foil, but not the opaque letters, to make the indicia highly readable. However, in more brightly lit areas the buttons appear with dark indicia on a shiny background. Thus the indicia are highly readable under all light conditions.

A rubber boot is used to help protect the circuits from moisture. The boot covers the bottom surface of the rigid PC board and has a peripheral edge which extends around and over the circumferential edges of the rigid and flexible printed circuit boards. A metal band is secured about the boot peripheral edge to create a water tight seal between the rubber boot and the moisture impervious flexible PC board.

A connector is secured to one end of the switch board and includes a number of contacts electrically connected to the various pressure sensitive switches.

Different nozzles can be used to accommodate different needs and jurisdictional requirements. According to one embodiment, each liquid passageway has separate entrance and exit ends so that different liquids never pass through the same conduits. In other embodiments, the outer sections of several liquid passageways are combined to form an enlarged, common liquid passage section. This enables the beverage passing through the outer portion of its passageway to slow down greatly due to the greatly increased cross-sectional area of the common passageway relative to the inside diameter of the liquid lines.

In another embodiment, rapid discharge and splashing is reduced by having the beverage pass through a widening venturi section. The liquid, since it follows the walls of the venturi section, reduces its velocity in proportion to the change in the cross-sectional area along the venturi. Thus, doubling the liquid passage diameter reduces the liquid speed by a factor of 4. In a further embodiment, separate liquid passageways are used for alcoholic beverages; soft drinks are dispensed using syrup from different syrup lines and carbonated water from its line, the syrup and carbonated water passageways combining to an enlarged common liquid passageway section. Good mixing is aided by slowing the syrup velocity down through the use of venturis and the large diameter common liquid passageway section. Dispensing the carbonated water into the common passageway so that it impinges against the walls of the common passageway helps to assure full mixing.

Other features and advantages of the invention will appear from the following description from which the preferred embodiments have been set forth in detail in conjunction with the accompanying drawings.

DETAILED DESCRIPTION OF THE PREFERRED EMBODIMENTS

Figure 1:
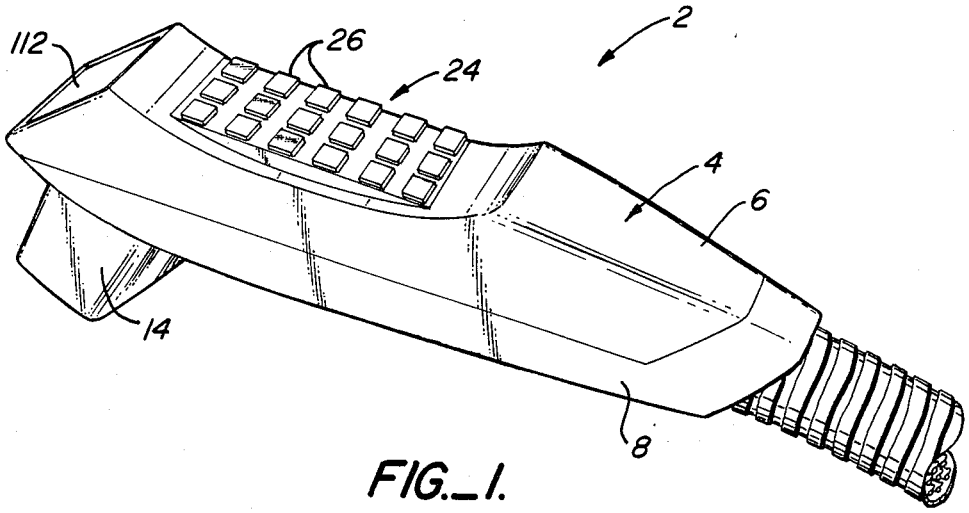
FIG. 1 is a perspective view of the beverage dispensing gun of the invention.
Figure 2:
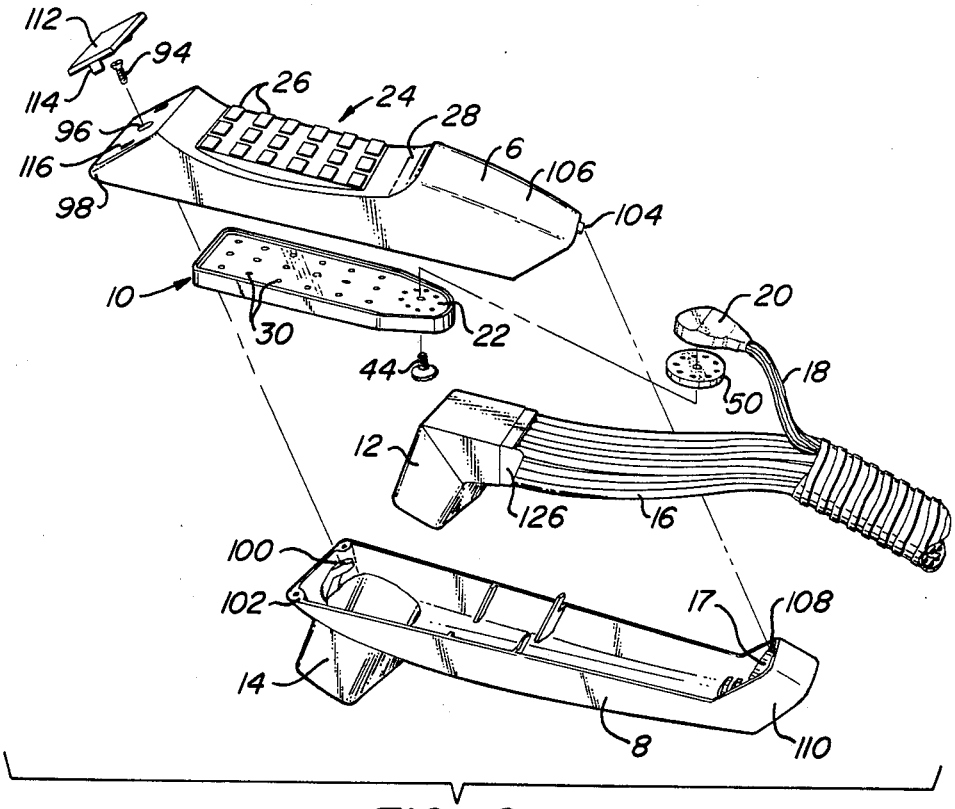
FIG. 2 is an exploded perspective view of the gun of FIG. 1.

Turning now to FIGS. 1 and 2, a beverage dispensing gun 2 is shown to include broadly a case 4, comprising an upper half 6 and lower half 8, a switch board assembly 10 mounted within the case and a nozzle 12 mounted within a nozzle compartment 14 of lower half 8 and connected to a number of beverage sources (not shown) through liquid lines 16. Lines 16 pass out of case 4 through a liquid line inlet 17 in lower half 8. Assembly 10 is electrically connected to a flow control box (not shown) through control wires 18 and a connector 20 which couples control wires 18 to various contacts 22 on assembly 10. A beverage selection button array 24 includes a number of selector buttons 26 mounted to an upper surface 28 of upper half 6. Switch board assembly 10 includes a number of pressure sensitive switches 30 positioned to underlie buttons 26 so that when the operator presses buttons 26 the underlying switch 30 is actuated.

Figure 3:
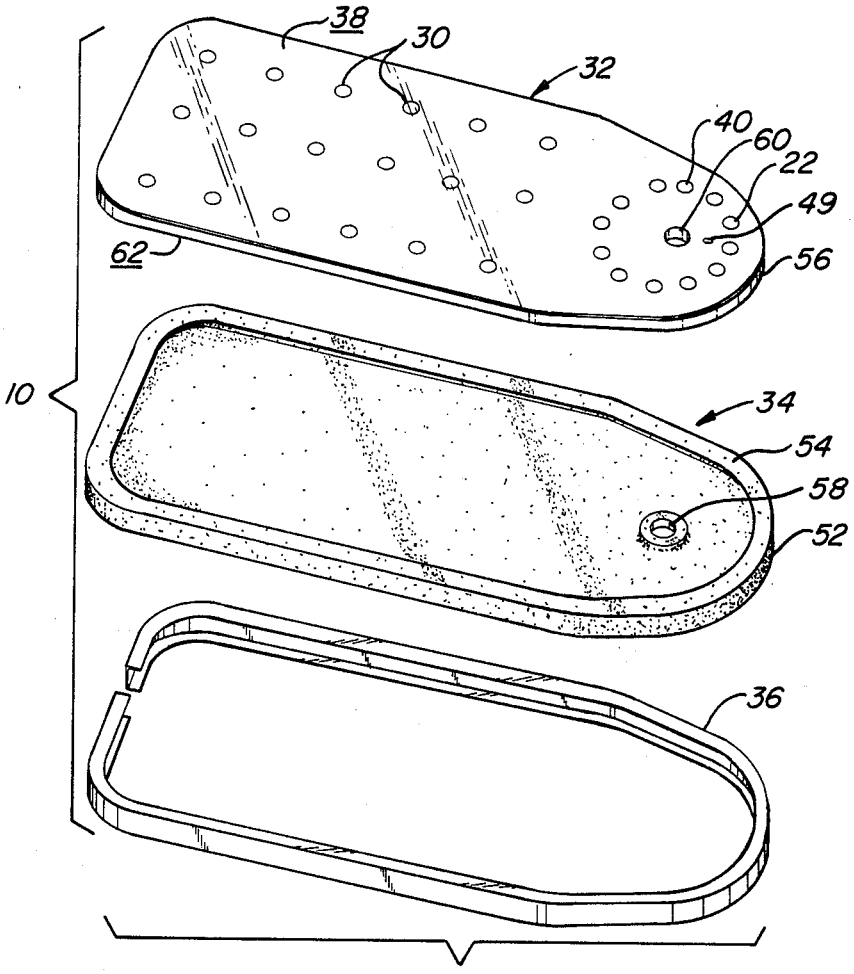
FIG. 3 is an exploded perspective view of the switch board assembly.
Figure 4:
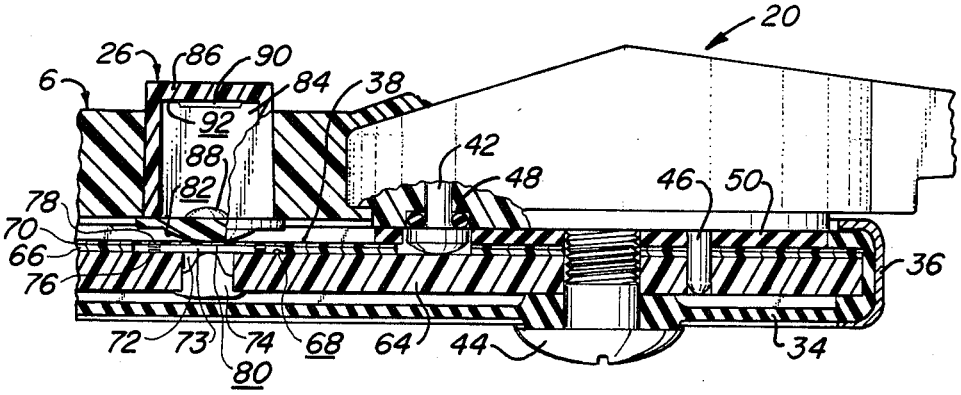
FIG. 4 is an enlarged cross-sectional view of a portion of the switch board assembly, connector and upper case half.

Referring now to FIGS. 3 and 4, switch board assembly 10 will be described. Switch board assembly 10 includes a switch board 32, a rubber boot 34 and a circumferential band 36. The upper surface 38 of switch board 32 is a sheet of flexible, water impervious plastic, such as that sold under the trademark Mylar, to protect the upper surface from moisture. A number of openings 40 are made above contacts 22 to permit the contacts 42 carried by connector 20 to engage contacts 22. Connector 20 is secured to switch assembly 10 by a screw 44. Proper alignment is achieved by an alignment pin 46 extending from connector 20 into an alignment hole 49 within switch board 32. Contacts 42 are spring biased toward contacts 22 through the use of resilient O-rings 48. A water tight seal for contacts 22 and 42 is achieved through the use of a resilient sealing member 50 captured between connector 20 and upper surface 38.

Rubber boot 34 includes an upwardly extending peripheral edge 52 and an inwardly extending lip 54 sized to fit snugly around the circumferential edge 56 of switch board 32. An opening 58 is made in boot 34 to allow screw 44 to pass through the boot, through an opening 60 and switch board 32 and into connector 20. Band 36 is made of a deformable metal, such as copper, and is mounted about peripheral edge 52 of boot 34 after boot 34 has been mounted to switch board 32 covering the bottom surface 62 and circumferential edge 56 of switch board 32. Band 36 is then tightened again so that it presses lip 54 against upper surface 38 thus insuring a water tight seal.

Switch board 32 is made of three layers, a rigid printed circuit (PC) board 64, a spacer film 66 adhesively mounted to the upper surface 68 of printed circuit board 64, and a flexible PC board 70, typically made of Mylar, adhesively mounted to and overlying spacer film 66. Flexible PC board defines water impervious upper surface 38 of switch board 32. Beneath each button 26 holes 72, 73 are formed in rigid PC board 64 and spacer film 66 respectively. A constantly energized light emitting diode (LED) 74 is mounted within hole 72 to provide illumination of transparent button 26 to aid the user in dimly lit areas.

Switch 30 includes a first PC contact 76 mounted to upper surface 68 of rigid PC board 64 in the region surrounding hole 72 and a second PC contact 78 mounted to the lower surface 80 of flexible PC board 70 in the region directly overlying first PC contact 76. Switch 30 is actuated by the pressing of button 26 which flexes flexible PC board 70 sufficiently so that first and second PC contacts 76, 78 touch to complete the circuit. Flexible PC board 70, being adhesively secured to spacer film 66, acts as a resilient member of pressure sensitive switch 30 to keep switch 30 normally open. The open regions defined by holes 72 and 73 between flexible PC board 70 and LED 74 act as air cushions when buttons 26 press on flexible PC board 70.

Button 26 is made of clear plastic and includes a lower arcuate contact surface 82, a hollow interior 84 and a clear top 86. A lens 88 overlies arcuate surface 82 to direct light from LED through top 86. Indicia identifying which button corresponds to which liquid is provided by a metallized foil 90 having opaque indicia thereon. Typically the metallized foil is a plastic film on which a thin layer of aluminum is vacuum deposited to provide in effect a one way mirror. This acts as the background upon which opaque indicia, for example GIN, VOD for vodka or W for water, are printed. Under some conditions, the light outside gun 2 is brighter than the light within the gun so that the metallized foil background appears as a shiny silvery background in contrast with the opaque indicia, which is typically black. Under low light conditions, when the light inside gun 2 is brighter than the ambient light, LEDs 74 illuminate buttons 26 from beneath to provide an attractive and very readable display of the indicia. This combination provides a distinct, useful and attractive method of identifying the buttons 26 under normal and low light conditions. If desired, rather than using a separate metallized foil 90 including opaque indicia, either the indicia or the metallized foil background or both may be deposited directly on the underside surface 92 of top 86. Placing the indicia on underside surface 92 keeps them from being obliterated by use.

Figure 5A:
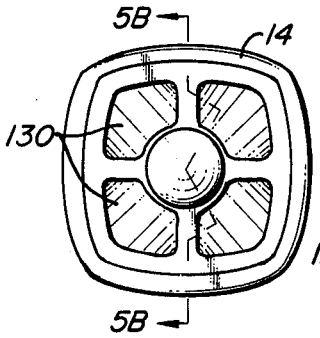
FIGS. 5A and 5B are end and cross-sectional views of the nozzle of FIG. 1.
Figure 5B:
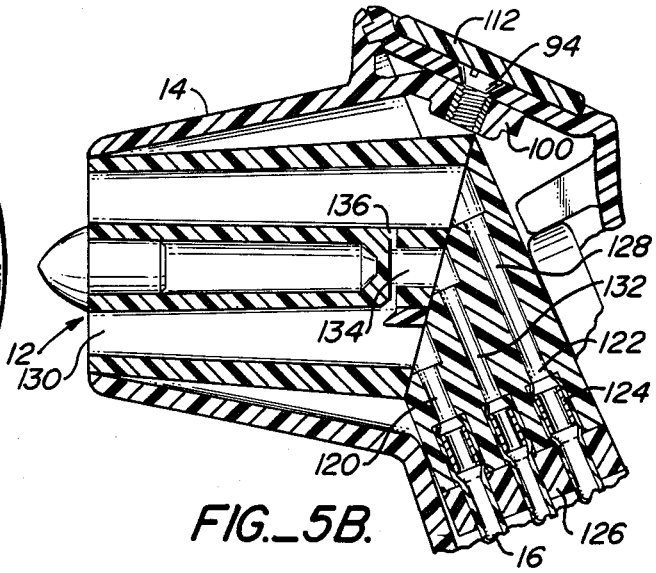

Referring to FIGS. 2 and 5B, upper and lower halves 6, 8 of case 4 are secured together using a single screw 94 which passes through an opening 96 at the front 98 of upper half 6 for threadable engagement with a threaded extension 100 at the front end 102 of lower half 8. A retaining tab 104 extends rearwardly from the rear end 106 of upper half 6 for engagement under a lip 108 formed by lower half 8 at its rear end 110. Screw 94 is by a removable name plate 112. Name plate 112 is removably mounted to front end 98 by engagement of a pair of resilient tabs 114 into slots 116 formed on either side of opening 96. Thus access to the interior of gun 2 is by the removal of a single screw 94.

Turning now to FIGS. 5A and 5B, nozzle 12 will be described. Nozzle 12 is doglegged-shaped and defines a number of liquid passageways 120. Liquid lines 16 are connected to the entrance ends 122 of passageways 120 and are secured thereto by the use of cylindrical ferrules 124, inserted within the interior of tubes 116, and a keeper 126, which is slid over tubes 116 and against the end of nozzle 12 adjacent entrance ends 122. Since the openings in keeper 126 are slightly smaller than the outside diameter of flexible liquid lines 126, the ends of containing ferrules 124 are too large to pass through keeper 126. Liquid lines 126 are therefore secured within entrance ends 122. The inside diameter of ferrules 124 is approximately the same as the inside diameter of liquid lines 16 so that ferrules 124 do not constrict fluid flow.

Liquid passageways 120 include narrow sections 128 and enlarged, common sections 130. Several narrow sections 128 combine to form enlarged sections 130 so that sections 130 act as common liquid passageways for a variety of beverages. Similar beverages, such as clear liquors, are passed through the same common liquid passageway 130. Narrow sections 128 intersect enlarged, common sections 130 at an angle so that the liquid strikes the side walls of common sections 130 thus slowing down the passage of liquid flowing through nozzle 12. Water or soda is passed through a center liquid passageway 132, which is modified somewhat from the other passageways. Center passageway 132 includes a narrow section 128 which enters into a sprayer section 134. Sprayer section 134 includes forwardly and outwardly angled orifices 136 which spray water or soda into each of the common passageways 130 each time the water or soda button is pressed. In this way, the walls of the common passageways are washed down each time water or soda is dispensed from gun 2 so that the gun is practically self-cleaning during use.

Figure 6A:
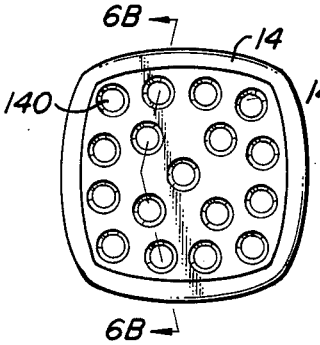
FIGS. 6A, 6B, 7A and 7B are end and cross-sectional views of alternative embodiments of the nozzle of FIGS. 5A and 5B.
Figure 6B:
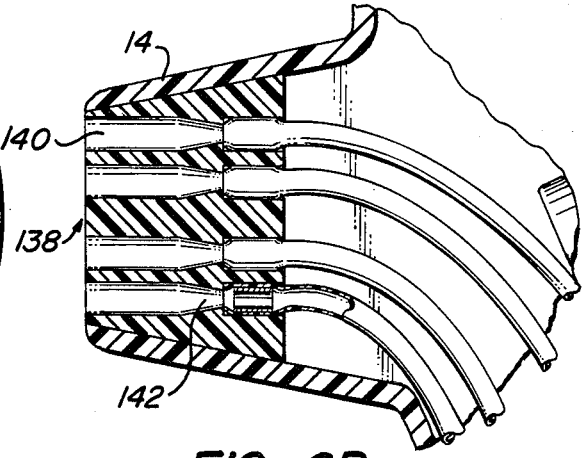

Turning to FIGS. 6A and 6B, an alternative nozzle 138 is shown mounted within nozzle compartment 14. In this embodiment, all liquid passageways 40 are separate, as is required in some jurisdictions. However, in lieu of directing the liquid at an angle into an enlarged passageway where it swirls about the passageway thus substantially filling it and reducing the fluid flow speed, passageways 140 include venturi regions 142. Regions 142 act in a conventional manner to reduce the speed of the liquid flowing along passageways 140 by increasing the area of the passageways. Doubling the diameter of the passageway increases the area by a factor of 4 thus reducing the speed by a factor of 4 to eliminate the splashing of the beverage in the glass.

Figure 7A:
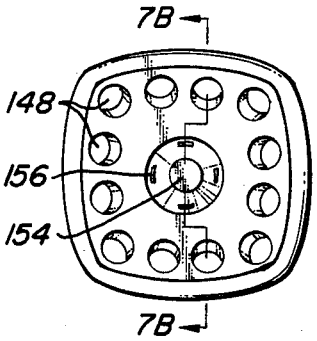
Figure 7B:
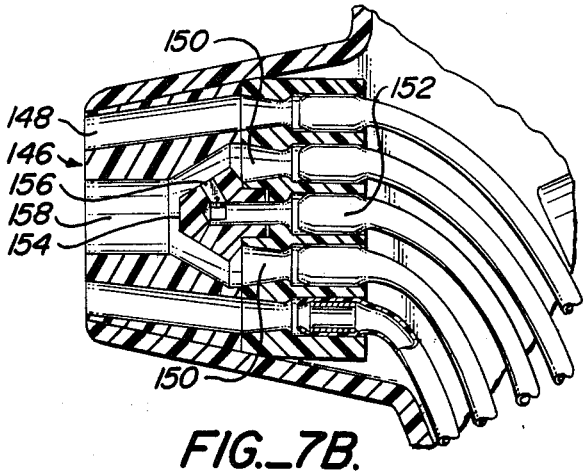

FIGS. 7A and 7B show nozzle 146 combining features of nozzles 118 and 138. The circumferentially placed liquid passageways 148 are similar to liquid passageways 142 of FIGS. 6A and 6B and are commonly used for alcoholic beverages. The interior passageways 150 are used for soft drink beverage syrups while the centermost liquid passageway 152 is used for soda in conjunction with a sprayer 154 having a number of orifices 156. The soft drink syrup passing through a passageway 150 is mixed with soda passing from orifices 156, which are at an angle into the common passageway section 158 of internal passageways 150. Sprayer nozzle 154 acts to both mix the soda with the soft drink syrup and also wash down common passageway section 158 between uses.

In use the operator presses the appropriate button 26 causing switch 30 underlying button 26 to close. LEDs 26, illuminating the underside of foil 90, aid the selection of the correct button 26 under low light conditions. Actuating switch 30 is sensed by appropriate control circuitry, which is not part of this invention, through control wires 18. The appropriate liquid in the appropriate amount is forced through liquid line 16 where it passes through the liquid passageways in a nozzle. The speed of discharge is controlled by increasing the area of the liquid passageway betwen the entrance and exit ends.

Modifications and variations can be made to the disclosed embodiments without departing from the subject of the invention as defined in the following claims. For example, wires 18 may be soldered directly to contacts 22 in lieu of using connector 20. If desired button array 24 may be eliminated to allow the user to directly contact flexible PC board 70 which would have identifying indicia printed thereon.

I claim:

1. A beverage dispensing gun for selectively dispensing a plurality of liquids provided the gun along a plurality of liquid lines comprising:

a case having a liquid line inlet;

a nozzle mounted to said case and fluidly connected to the liquid lines;

a switch board, mounted within the case, including an array of user actuated pressure sensitive switches for controlling the flow of liquid from the liquid lines to the nozzle;

the switch board further including a plurality of first contacts arranged in a chosen pattern on said switch board;

a connector including plurality of second contacts arranged in said chosen pattern for mating engagement with said first contacts; and means for sealingly and removably securing said connector to said switch board, said connector securing means including a resilient sealing member positioned between the connector and the switch board.

2. The gun of claim 1 wherein said switch board includes:

upper and lower surfaces and a peripheral edge;

a flexible, water repelling upper layer at the upper surface;

a flexible, water repelling boot covering the lower surface and having an upwardly extending peripheral portion adapted to cover the peripheral edge of the switch board and terminating at a boot lip overlying said upper layer; and a circumferential sealing band mounted over the peripheral portion of the boot to sealably secure the boot to the switch board.

3. A beverage dispensing gun for selectively dispensing a plurality of liquids provided the gun along a plurality of liquid lines comprising:

a case having a liquid line inlet;

a nozzle mounted to said case and fluidly connected to the liquid lines;

a switch board, mounted within the case, having upper and lower surfaces and including user actuated pressure sensitive switches, for controlling the flow of liquid through the liquid lines and to the nozzle, and a plurality of first contacts arranged in a chosen pattern at at least one of said upper and lower surfaces, said first contacts being free of overlying material;

a connector including plurality of second contacts arranged in said chosen pattern for mating engagement with said first contacts, the connector including a connector body and resilient O-rings mounted between the second contacts and the connector body to bias the second contacts against the first contacts; and means for sealingly and removably securing said connector to said switch board and including a sealing member positioned between the connector and the switch board.

4. A beverage dispensing gun for selectively dispensing a plurality of liquids provided the gun along a plurality of liquid lines comprising:

a case having a liquid line inlet;

a nozzle mounted to said case and fluidly connected, to the liquid lines;

a switch board, mounted within the case and having upper and lower surfaces, including a rigid printed circuit board having a first printed circuit thereon, a flexible printed circuit board having a second printed circuit thereon, a separator layer mounted between said rigid and flexible printed circuit boards at regions other than at a plurality of switch areas, portions of said first and second printed circuits at said switch areas confronting one another so said flexible and rigid printed circuit boards and said first and second printed circuit portions constitute pressure sensitive switches for controlling the flow of liquid through the liquid lines and to the nozzle;

the switch board further including a plurality of first contacts arranged in a chosen pattern on said rigid circuit board;

a connector including plurality of second contacts arranged in said chosen pattern for mating engagement with said first contacts, said separator layer and flexible circuit board being configured so said first contacts are free of overlying material to permit physical contact by said second contacts;

the connector further including O-rings adjacent second contacts for biasing said second contacts against said first contacts;

means for sealingly and removably securing said connector to said switch board; and user operated means, overlying said switch areas, for actuating the underlying pressure sensitive switches.

5. The gun of claim 4 wherein said separator layer is bonded to the flexible and rigid printed circuit boards so to create air cushion regions at said switch areas.

6. A beverage dispensing gun for selectively dispensing a plurality of liquids provided the gun along a plurality of liquid lines comprising:

a case having a liquid line inlet;

a nozzle mounted to said case and fluidly connected to the liquid lines;

a switch board, mounted within the case and having upper and lower surfaces, including a rigid printed circuit board having a first printed circuit thereon, a flexible printed circuit board having a second printed circuit thereon, a separator layer mounted between said rigid and flexible printed circuit boards at regions other than at a plurality of switch areas, portions of said first and second printed circuits at said switch areas confronting one another so said flexible and rigid printed circuit boards and said first and second printed circuit portions constitute pressure sensitive switches for controlling the flow of liquid through the liquid lines and to the nozzle;

the switch board further including a plurality of first contacts arranged in a chosen pattern on said rigid circuit board;

a connector including plurality of second contacts arranged in said chosen pattern for mating engagement with said first contacts, said separator layer and flexible circuit board being configured so said first contacts are free of overlying material to permit physical contact by said second contacts;

the connector further including O-rings adjacent said second contacts for biasing said second contacts against said first contacts;

means for sealingly and removably securing said connector to said switch board;

a plurality of movable selector buttons mounted to the case, said selector buttons and said switch board positioned so said upper surface of said switch board is adjacent the movable selector buttons, said pressure sensitive switches underlying corresponding selector buttons so that depressing a selector button actuates the underlying pressure sensitive switch;

illuminating devices mounted to said switch board and positioned directly under the switch areas to illuminate the corresponding underlying selector buttons, said selector buttons adapted to permit light to pass therethrough; and said selector buttons include identifying indicia.

7. A beverage dispensing gun for selectively dispensing a plurality of liquids provided the gun along a plurality of liquid lines comprising:

a case having a liquid line inlet;

a nozzle mounted to said case and fluidly connected to the liquid lines;

a switch board, mounted within the case, having upper and lower surfaces and including pressure sensitive switches, for controlling the flow of liquid through the liquid lines and to the nozzle, and a plurality of first contacts arranged in a chosen pattern at at least one of said upper and lower surfaces, said first contacts being free of overlying material;

a connector including plurality of second contacts arranged in said chosen pattern for mating engagement with said first contacts, the connector including a connector body and resilient O-rings mounted between the second contacts and the connector body to bias the second contacts against the first contacts;

means for sealingly and removably securing said connector to said switch board and including a sealing member positioned between the connector and the switch board; and a plurality of movable selector buttons mounted to the case, said selector buttons and said switch board positioned so said upper surface of said switch board is adjacent the movable selector buttons, said pressure sensitive switches underlying corresponding selector buttons so that depressing a selector button actuates the underlying pressure sensitive switch, said selector buttons including identifying indicia.

8. The gun of claim 7 wherein said connector securing means includes a screw connecting the switch board, the sealing member and the connector to one another.

9. A beverage dispensing gun for selectively dispensing a plurality of liquids provided the gun along a plurality of liquid lines comprising:

a case having a liquid line inlet;

a nozzle mounted to said case and fluidly connected to the liquid lines;

a switch board, mounted to the case and having upper and lower surfaces, including a rigid printed circuit board having a first printed circuit thereon, a flexible printed circuit board having a second printed circuit thereon, a separator layer mounted between said rigid and flexible printed circuit boards at regions other than at a plurality of switch areas, portions of said first and second printed circuits at said switch areas confronting one another so said flexible and rigid printed circuit boards and said first and second printed circuit portions constitute pressure sensitive switches;

the switch board further including a plurality of first contacts arranged in a chosen pattern on said rigid circuit board;

a connector including plurality of second contacts arranged in said chosen pattern for mating engagement with said first contacts, said separator layer and flexible circuit board being configured so said first contacts are free of overlying material to permit physical contact by said second contacts;

means for sealingly and removably securing said connector to said switch board, said connector securing means including a resilient sealing member positioned between the connector and the switch board;

a plurality of movable selector buttons mounted to the case, said selector buttons and said switch board positioned so said upper surface of said switch board is adjacent the movable selector buttons, said pressure sensitive switches underlying corresponding selector buttons so that depressing a selector button actuates the underlying pressure sensitive switch so to control the flow of liquid through the liquid lines and to the nozzle;

illuminating devices mounted to said switch board and positioned directly under the switch areas to illuminate the corresponding overlying selector buttons, said selector buttons adapted to permit light to pass therethrough; and said selector buttons include identifying indicia.

10. The gun of claim 9 wherein said illuminating devices are mounted within recessed areas formed in said switch board.

11. The gun of claim 9 further comprising lens positioned between each illumination device and the indicia.

12. The gun of claim 9 wherein said illuminating devices include light emitting diodes.

13. The gun of claim 9 wherein said switch board includes:

a flexible, water repelling upper layer;

a flexible, water repelling boot covering the switch board lower surface and having an upwardly extending peripheral portion adapted to cover the peripheral edge of the switch board and terminating at a boot lip overlying said upper layer; and a circumferential sealing band mounted over the peripheral portion of the boot to sealably secure the boot to the switch board.

14. The gun of claim 9 wherein said case includes upper and lower halves having first and second ends, said upper and lower halves including a retaining tab and complementary lip at the first end and means for threadably securing said halves to one another with a single screw at the second end.

15. The gun of claim 9 wherein said separator layer is bonded to the flexible and rigid printed circuit boards so to create air cushion regions at said switch areas.

16. The gun of claim 9 wherein said connector securing means includes a screw connecting the switch board, the resilient sealing member and the connector to one another.

17. The gun of claim 9 wherein said chosen pattern is circular.

18. The gun of claim 9 wherein the identifying indicia include translucent and opaque portions.

19. The gun of claim 9 wherein said translucent portions include metallized foil.

20. The gun of claim 18 wherein said translucent portions are background and said opaque portions are identifying indicia.

21. The gun of claim 9 wherein the connector includes means for biasing said second contacts against said first contacts.

22. The gun of claim 21 wherein said biasing means includes O-rings adjacent said second contacts.

* * * * *